US008079776B2

(12) United States Patent
Lossow

(10) Patent No.: US 8,079,776 B2
(45) Date of Patent: Dec. 20, 2011

(54) PAVER FOR THE PAVING OF GROUND COURSES FOR ROADS OR THE LIKE

(75) Inventor: Ludwig T. Lossow, Hameln (DE)

(73) Assignee: ABG Allgemeine Baumaschinen-Gesellschaft mbH, Hameln (DE)

( * ) Notice: Subject to any disclaimer, the term of this patent is extended or adjusted under 35 U.S.C. 154(b) by 311 days.

(21) Appl. No.: 11/920,173

(22) PCT Filed: May 9, 2006

(86) PCT No.: PCT/EP2006/004301

§ 371 (c)(1),
(2), (4) Date: Jan. 26, 2009

(87) PCT Pub. No.: WO2006/119954

PCT Pub. Date: Nov. 16, 2006

(65) Prior Publication Data

US 2009/0226255 A1 Sep. 10, 2009

(30) Foreign Application Priority Data

May 10, 2005 (DE) ..... 10 2005 022 266

(51) Int. Cl.
*E01C 23/07* (2006.01)

(52) U.S. Cl. ..... 404/84.5; 404/84.1

(58) Field of Classification Search ..... 404/84.05–84.5, 404/118

See application file for complete search history.

(56) References Cited

U.S. PATENT DOCUMENTS

| | | | | |
|---|---|---|---|---|
| 3,519,169 | A * | 7/1970 | Holland | 222/626 |
| 3,691,916 | A * | 9/1972 | Martenson et al. | 404/84.2 |
| 4,722,636 | A * | 2/1988 | Brock | 404/84.1 |
| 4,925,340 | A * | 5/1990 | Heiser et al. | 404/75 |
| 5,752,783 | A * | 5/1998 | Malone | 404/84.2 |
| 6,238,123 | B1 * | 5/2001 | Schwarzbich | 403/45 |
| 6,672,797 | B1 | 1/2004 | Zachman et al. | |
| 6,890,125 | B1 * | 5/2005 | Calder et al. | 404/104 |
| 7,044,680 | B2 * | 5/2006 | Godbersen et al. | 404/75 |

FOREIGN PATENT DOCUMENTS

| | | | |
|---|---|---|---|
| DE | 196 37 150 | A1 | 4/1998 |
| DE | 198 36 269 | C1 | 8/1998 |
| DE | 199 51 297 | C1 | 10/1999 |
| EP | 1 179 636 | A1 | 2/2002 |
| JP | 02136405 | * | 5/1990 |

* cited by examiner

*Primary Examiner* — Raymond Addie
(74) *Attorney, Agent, or Firm* — Alix, Yale & Ristas, LLP

(57) ABSTRACT

The invention relates to a paver for the paving of ground courses for roads or the like, comprising a chassis and a trailed floating screed which is articulated on the latter via tow arms and of which the angle of attack relative to the ground can be adjusted via an actuating cylinder, arranged on each of the two sides of the chassis, for displacing the tow point of the tow arms, a tow-point displacement controller for setting the tow point corresponding to an intended paving height dimension of the screed being provided for each side, characterized in that displacement sensors for measuring the displacement movements of the actuating cylinders are provided and are coupled to a control unit which evaluates the displacement signals of the tow-point displacement controllers, which control unit records the displacement movements as control values and compares them with a nominal control value range for displacement movements that can be stored in the control unit and corrects recorded control values outside the nominal control value range.

16 Claims, 1 Drawing Sheet

PAVER FOR THE PAVING OF GROUND COURSES FOR ROADS OR THE LIKE

The invention relates to a paver for the paving of ground courses for roads or the like.

It is known practice in such pavers to adjust the angle of attack of the floating screed, and thus the paving height dimension, by displacing the tow point of tow arms for the screed to a desired value, an independent tow-point displacement controller for setting the tow point being provided for each side of the paver and the screed height being measured in relation to a reference line and the tow-point height being regulated with respect to the deviation of the screed height from a setpoint value. These two tow-point displacement controllers work independently of one another. Here, short-cycle pulses are emitted at the actuating outputs of the tow-point displacement controllers and are used to adjust the stroke of the actuating cylinders via suitable valve hydraulics. As the deviation from the setpoint value increases, longer pulses are used for counter-control purposes in order to keep the screed at the desired height position.

However, when displacing, for example, the left tow point, the left-side controller does not know what position the right tow point is holding or what movement it is performing, and vice versa.

Moreover, there is no direct information on the distance covered (for instance in mm) during a change in height of the tow arms after an actuating signal has been executed, and there is no fixed relationship between the actuating signal length and the change in length of the actuating cylinder.

It is thus possible for the resulting stroke movements to be too small or too large because of wear or ageing of hydraulic valves of the hydraulic system used for operating the actuating cylinders or because of the action of external forces. Continuous up and down movements may result if the sensitivity of the tow-point displacement controllers is set too high.

The object of the invention is to provide a paver in which incorrect settings of the tow points of the actuating cylinders for the screed are eliminated as far as possible.

Displacement sensors for measuring the displacement movements of the actuating cylinders are accordingly provided and are coupled to a control unit which evaluates the displacement signals of the tow-point displacement controllers, the control unit records the displacement movements as control values and compares them with a nominal control value range for displacement movements that can be stored in the control unit and corrects recorded control values outside the nominal control value range to values within the nominal control value range. Therefore, the displacement movements are monitored for plausibility, and if appropriate corrected.

The control unit intervenes when, in response to an actuating signal of a tow-point displacement controller, there results too small or too large a stroke movement of the actuating cylinder, for instance because hydraulic valves in the paver's hydraulic circuit containing the respective actuating cylinder no longer react or do not react sufficiently because of wear or ageing or if external forces act on the actuating cylinders. The latter may arise for example with greatly differing tow-point positions on the right and left. If, for example, actuating pulses result in virtually no displacement, the width thereof can be increased by the separate controller.

The control unit also intervenes when one of the tow-point displacement controllers activates a continuous upwards and downwards movement, i.e. an oscillating tow-point behaviour, for instance if the sensitivity of the tow-point displacement controllers is set too high.

The control unit furthermore intervenes when a great difference in height between the tow points on the right and left has been set, with the result that the screed is excessively distorted and may thus become damaged.

Instances of excessive manual overcontrol of the tow points can be detected and corrected by the control unit.

Since the actuating behaviour of the tow-point displacement controllers is correct for a limited speed range, with the result that a deviation therefrom would also require the actuating behaviour to be adapted, it is expedient if the control unit additionally evaluates the paving speed and, where there is an upward or downward deviation from an intended range therefor, correspondingly speeds up or slows down the displacement.

The control unit may, in particular, also contain the two tow-point displacement controllers, i.e. perform their function concomitantly. Accordingly, the control unit makes it possible to cover with incorporation of a preset profile of a stretch of road while laying the paving material.

Apart from the actuating signals of the tow-point displacement controllers, the control unit can also be supplied with setpoint values and actual values irrespective of whether the tow-point displacement controllers are integrated into the control unit or not.

The control unit also makes it possible, if appropriate, to intervene correctively in other machine functions if these negatively affect the paving result. Thus, it is known practice in pavers to use screed-transporting cylinders by means of which the screed is raised for the purpose of transporting the paver, for instance by means of low loader, and is retained in this position while being transported. When paving is taking place, the screed-transporting cylinders are usually in the floating position, i.e. such that no force is exerted by them on the screed. However, it is also known practice to additionally influence the paving operation by way of the screed-transporting cylinders and/or screed-loading cylinders by using them to partially relieve the load on the screed, to load the screed or to lock the screed. The latter variables can be influenced by the control unit to achieve an optimum paving result. Any screed-transporting/screed-loading cylinders present here may additionally be correspondingly activated by the control unit.

Further embodiments of the invention can be taken from the description below and from the subclaims.

The invention will be explained in more detail below by way of an exemplary embodiment represented in the appended drawings.

FIG. 1 is a schematic view showing details of a paver for the paving of ground courses for roads or the like.

FIG. 2 shows a diagram pertaining to the operation of a control unit for a paver for the paving of ground courses for roads or the like.

Figure 1:
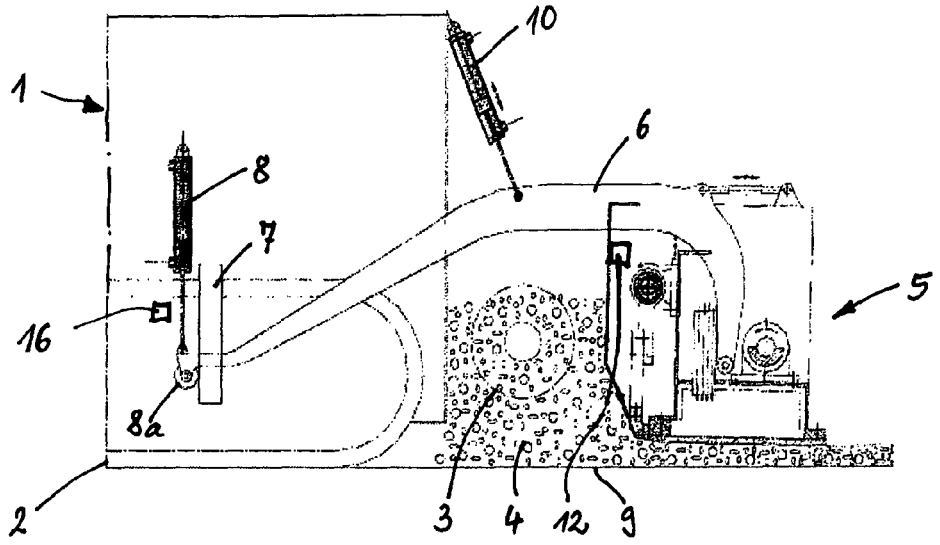

The schematically represented paver comprises a chassis 1 with a travelling mechanism 2, here represented as a crawler-type travelling mechanism (a wheel-type travelling mechanism may also be provided instead), the chassis 1 being provided at the front with a hopper (not shown) for holding paving material, for example mix such as asphalt, and at the rear with a distributor auger 3 for the distribution of paving material 4 conveyed by means of a conveyor (not shown) through the chassis.

A floating screed 5 for the floating paving of paving material 4 is articulated on the chassis 1 via a respective tow arm 6 on the right-hand side and on the left-hand side of the chassis 1. The screed 5 is situated, as seen in the paving direction, behind the region of the distributor auger 3 and may comprise a basic screed and, with respect to the latter, laterally and independently extendable extension screeds and/or attached screed-widening parts. The basic screed is conventionally divided centrally, the two halves of the basic screed being capable of being inclined relative to one another transversely to the paving direction via a corresponding actuating device for the purpose of setting a roof-shaped profile.

Each tow arm 6 is articulated pivotably at its front end on the chassis 1, the articulation point being height-adjustable with respect to the chassis 1. This is brought about, for example, by the fact that the tow arm 6 is forked at its front end, has its forked end engaging round a flat bar 7 serving as a guide, and is supported on the flat bar 7 via a bearing ring of a bearing 8*a* which is arranged in the forked end and which absorbs tensile forces, while an actuating cylinder acts on the forked end and determines the height of the articulation point with respect to the chassis 1 for the purpose of varying the paving thickness or levelling, thereby also having an influence on the angle of attack, which is to be set positively, of the screed 5 relative to the surface of the paving material 4 laid by the screed 5.

Screed-transporting cylinders 10 are used for raising the screed 5 in the transport position. Apart from the case described above when the paver starts up again, these cylinders are generally in the floating position when paving is taking place.

During paving, the screed-transporting cylinders 10 can be used to partially relieve the load on the screed by transmitting some of the weight of the screed 5 to the chassis 1. When paving with paving material 4 in the form of mix having a low load-bearing capacity, the screed 5 is caused to be lowered while the paver is at a standstill by locking the screed via the screed-transporting cylinders 10. The screed-transporting cylinders 10 can also prevent the screed 5 from rising when the paver starts up again by being locked on the piston side and/or subjected to additional pressure loading.

For the purposes of displacing the actuating cylinders 8, each of them is provided with a tow-point displacement controller 11*a* and 11*b*. The latter use as actual values signals of an associated right or left paving height sensor 12, while a paving height dimension dependent on the profile of the stretch of road to be paved is prescribed as the setpoint value. The paving height sensors 12 generally do not measure the paving height but the height of the screed 5 relative to a reference line, for instance the ground 9 or a span wire or the like. The tow-point displacement controllers 11*a*, 11*b* produce actuating signals of a certain width in order to move the tow points of the tow arms 6 upwards or downwards and thereby set the floating height of the screed 5. For this purpose, corresponding hydraulic valves 13 of two corresponding hydraulic circuits of the paver are activated.

The two tow-point displacement controllers 11*a*, 11*b* are coupled with or integrated into a control unit 14. Paving parameters are input into the control unit 14 for instance via a central computer 15 in the driver's cab of the paver or the like; if appropriate, paver-specific parameters are also input or can be input automatically.

The two actuating cylinders 8 are each provided with displacement sensors 16 to monitor the displacement movements of the actuating cylinders 8 or their tow-point position. As already described above, the signals of the displacement sensors 16 are monitored for plausibility by the control unit 14, with, if appropriate, the actuating signal width of the tow-point displacement controllers 11*a*, 11*b* or their control sensitivity being adjusted.

The displacement movements which are measured by displacement sensors 16 are recorded by the control unit 14 as control values and compared with a nominal control value range for displacement movements that can be stored in the control unit 14 and recorded control values outside the nominal control value range are corrected to values within the nominal control value range.

It is also possible in this context for the control unit 14 to receive and process signals from supplementary sensors, for example from a sensor 17 for detecting the speed of travel of the paver and from sensors 18 for detecting the force exerted on the screed 5 by the screed-transporting cylinders 10, or the locking/non-locking of the screed 5.

Figure 2:
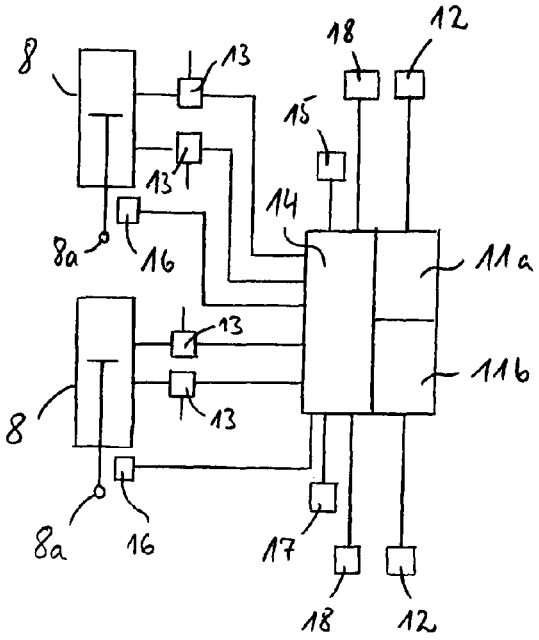

As represented in FIG. 2, the control unit 14 is expediently connected between the tow-point displacement controllers 11*a*, 11*b* and the hydraulic valves 13, the signals coming from the tow-point displacement controllers 11*a*, 11*b* being forwarded by the control unit 14 to the hydraulic valves 13, having been corrected if appropriate. This provides a simple configuration; it is possible in particular for known tow-point displacement controllers 11*a*, 11*b* to be used without modification, in particular without an interface to the control unit 14. Provision is made, if appropriate, for tow-point displacement controllers 11*a*, 11*b* which have an interface for communication with, and in particular for receiving correction information from, the control unit 14 and accordingly modify the activation of the hydraulic valves 13.

Provision can also be made for the control unit 14 to trigger or emit a cylinder end-position alert, particularly a visual and/or acoustic alert, to the operating personnel if one of the actuating cylinders 8 or one of any screed-transporting/screed-loading cylinders present is in a mechanical end position or comes closer to this end position than prescribed by a settable threshold value.

The invention claimed is:

1. A paver for the paving of ground courses for roads or the like, comprising:

a chassis having right and left sides, a trailed floating screed which is articulated at tow points on the chassis by tow arms and has an angle of attack relative to the ground that can be adjusted by an actuating cylinder, arranged on each of the sides of the chassis, for displacing the tow point of the tow arms, a tow-point displacement controller for each side that generates a displacement actuation signal to the actuating cylinder for setting the tow point corresponding to an intended paving height dimension of the screed for each side, displacement sensors for measuring the displacement movements of the actuating cylinders, a control unit coupled to the displacement sensors, which records the displacement movements as control values and compares them with a nominal control value range for displacement movements that can be stored in the control unit and corrects recorded control values outside the nominal control value range to values within the nominal control value range by amending the displacement actuation signals from the tow-point displacement controllers to the actuating cylinders;

wherein the control unit corrects incorrect settings of tow points of the actuating cylinders by monitoring the displacement movements for plausibility.

2. Paver according to claim 1, wherein the displacement actuation signal to the actuating cylinder is in the form of variable pulse width signals_and the amendment by the control unit can adjust the actuating signal pulse width of the tow-point displacement controllers.

3. Paver according to claim 1, wherein the control unit can deactivate an oscillating tow-point displacement actuation signal of the tow-point displacement controllers.

4. Paver according to claim 1, wherein the control unit can control a tow-point height difference between the right and left side over a predetermined range.

5. Paver according to claim 2, wherein the control unit can adjust the actuating signal pulse width of the tow-point displacement controllers corresponding to the speed of travel of the paver.

6. Paver according to claim 1, wherein the control unit can adjust forces exerted on the screed by screed-loading cylinders and/or screed-transporting cylinders by means of which the screed is articulated on the chassis.

7. Paver according to claim 1, wherein the tow-point displacement controllers are integrated into the control unit.

8. Paver according to claim 6, including sensors for monitoring the movement of the screed-transporting and/or screed-loading cylinders, coupled to the control unit.

9. Paver according to claim 1, wherein the control unit can trigger a cylinder end-position alert.

10. Paver according to claim 2, wherein the control unit can deactivate an oscillating tow-point displacement actuation signal of the tow-point displacement controllers.

11. Paver according to claim 2, wherein the control unit can control a tow-point height difference between the right and left side over a predetermined range.

12. Paver according to claim 10, wherein the control unit can adjust the actuating signal pulse width of the tow-point displacement controllers corresponding to the speed of travel of the paver.

13. Paver according to claim 2, wherein the control unit can adjust forces exerted on the screed by screed-loading cylinders and/or screed-transporting cylinders by means of which the screed is articulated on the chassis.

14. Paver according to claim 2, wherein the tow-point displacement controllers are integrated into the control unit.

15. Paver according to claim 13, including sensors for monitoring the movement of screed-transporting and/or screed-loading cylinders, coupled to the control unit.

16. Paver according to claim 2, wherein the control unit can trigger a cylinder end-position alert.

* * * * *